US006559822B2

(12) United States Patent
Okuzono

(10) Patent No.: US 6,559,822 B2
(45) **Date of Patent: *May 6, 2003**

(54) ACTIVE MATRIX-TYPE LIQUID CRYSTAL DISPLAY DEVICE

(75) Inventor: Noboru Okuzono, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 6 days.

(21) Appl. No.: 09/299,025

(22) Filed: Apr. 26, 1999

(65) Prior Publication Data

US 2002/0067330 A1 Jun. 6, 2002

(30) Foreign Application Priority Data

May 22, 1998 (JP) ..... 10-158558

(51) Int. Cl.[7] ..... G09G 3/36
(52) U.S. Cl. ..... 345/96; 345/99
(58) Field of Search ..... 345/98–99, 100, 345/96, 209, 103; 349/139, 142, 143, 149

(56) References Cited

U.S. PATENT DOCUMENTS 4,842,371 A * 6/1989 Yasuda et al. ..... 350/333
5,365,284 A * 11/1994 Matsumoto et al. ..... 348/793
5,604,511 A * 2/1997 Ohi ..... 345/98
5,995,073 A * 11/1999 Isami et al. ..... 345/89
6,072,457 A * 6/2000 Hashimoto et al. ..... 345/100
6,075,505 A * 6/2000 Shiba et al. ..... 345/87
6,075,507 A * 6/2000 Miyahara et al. ..... 345/89
6,137,465 A * 10/2000 Sekine et al. ..... 345/98

FOREIGN PATENT DOCUMENTS

JP 10-187097 7/1998
JP A 10-187097 7/1998

* cited by examiner

*Primary Examiner*—Vijay Shankar
(74) *Attorney, Agent, or Firm*—Young & Thompson

(57) ABSTRACT

An active matrix-type liquid crystal display device which is capable of realizing a dot inversion driving by disposing H drivers on both sides of the liquid crystal panel, while using existing H driver circuits which output odd output data and even output data at opposite polarities to each other. The first and second H drivers, which output odd output data and even output data at opposite polarities to each other, are disposed facing each other on both sides of the liquid crystal panel, in order to realize an active matrix-type liquid crystal display device which is conducted by the dot inversion driving. Data electrodes of said liquid crystal display device are taken out for every two lines or every integer times of two lines and the thus taken out data lines are connected alternately to the first and second driver circuits.

6 Claims, 7 Drawing Sheets

Fig. 2B

| | | | | | | |
|---|---|---|---|---|---|---|
| I | + | I | + | I | + | I |
| + | I | + | I | + | I | + |
| I | + | I | + | I | + | I |
| + | I | + | I | + | I | + |
| I | + | I | + | I | + | I |
| + | I | + | I | + | I | + |
| I | + | I | + | I | + | I |
| + | I | + | I | + | I | + |
| I | + | I | + | I | + | I |

Fig. 2A

| | | | | | | |
|---|---|---|---|---|---|---|
| + | I | + | I | + | I | + |
| I | + | I | + | I | + | I |
| + | I | + | I | + | I | + |
| I | + | I | + | I | + | I |
| + | I | + | I | + | I | + |
| I | + | I | + | I | + | I |
| + | I | + | I | + | I | + |
| I | + | I | + | I | + | I |
| + | I | + | I | + | I | + |

HS
PC
LP
D1
D2
D3
D4
Dm−1
Dm
G1
G2

HS
PC
LP
D1
D2
D3
D4
Dm−1
Dm
G1
G2

ACTIVE MATRIX-TYPE LIQUID CRYSTAL DISPLAY DEVICE

BACKGROUND OF THE INVENTION

1. Field of the Invention

The present invention relates to a liquid crystal display device. and particularly relates to a dot inversion driving type active matrix-type liquid crystal display device.

This application is based on Patent Application No. Hei 10-158558, filed in Japan, the content of which is incorporated herein by reference.

2. Background Art

Conventionally, a dot inversion driving method has been used for driving an active matrix type liquid crystal display device to obtain high image quality while suppressing the influence of cross-talk.

The dot inversion driving method is, as shown in FIG. 2, the display device is driven by switching (inversion) the polarity of each pixel data for every scanning line as well as every field.

When this dot inversion driving method is applied to an active matrix-type liquid crystal panel with a small display screen, such as 6 inches, and with VGA (video graphics array) resolution, providing the H-(horizontal) driver circuit for driving data-lines (data-driver) being disposed on one side of the liquid crystal panel, the pixel pitch is calculated as 19 $\mu$m.

A problem arises that the above mentioned 19 $\mu$m is too small to afford a space for mounting terminals by pressure welding for connecting the H-driver and the liquid crystal panel.

In order to solve the above problem, one option is to dispose the H-driver circuits equally on both side of the liquid crystal panel so as to double the pitch space. Such structure is proposed in Japanese Patent Application, First Application No. Hei 7-219484, in which linear data electrodes are mounted so as to be connected alternately to two digital drivers disposed on both side of the liquid crystal panel.

However, the only existing H driver circuits having a high withstanding voltage and having 64 gradations output odd numbered data and even-numbered data at opposite polarities. Thus, it is necessary to develop a new driver circuit which is capable of conducting dot inversion in order to realize a liquid crystal panel in which the H-driver circuits are disposed on both sides of the panel.

It is therefore an object of the present invention to provide an active matrix type liquid crystal display panel which is capable of conducting dot inversion driving by disposing H drivers on both sides of the panel while utilizing the existing H driver circuits which output odd-numbered data and even-numbered data at opposite polarities to each other.

SUMMARY OF THE INVENTION

In order to solve the above problems, the present invention provides an active matrix-type liquid crystal panel which realizes a dot inversion driving by disposing on both sides of said liquid crystal panel existing high withstanding voltage source drivers (called "H drivers") which output odd output data and even output data at opposite polarities to each other against a common electrode of the liquid crystal panel; wherein, every two or every integer times of two of said data electrodes of the active matrix-type liquid crystal display device are taken out and connected to said driver circuits.

BRIEF DESCRIPTION OF THE DRAWINGS

FIGS. 2A and 2B are diagrams for explaining a principle of the dot inversion system.

DESCRIPTION OF THE PREFERRED EMBODIMENTS

Hereinafter, preferred embodiments of the present invention will be described. A liquid crystal display device of the present invention according to an embodiment of the present invention, disposing on both sides of the liquid crystal panel existing high voltage withstanding source drivers (hereinafter, called "H" driver), which output odd-numbered data and even-numbered data at opposite polarities to each other, realizes the dot inversion driving by deriving and connecting data wires for every two data line or for every integer line (multiples of two) to one H driver and the other.

Figure 1:
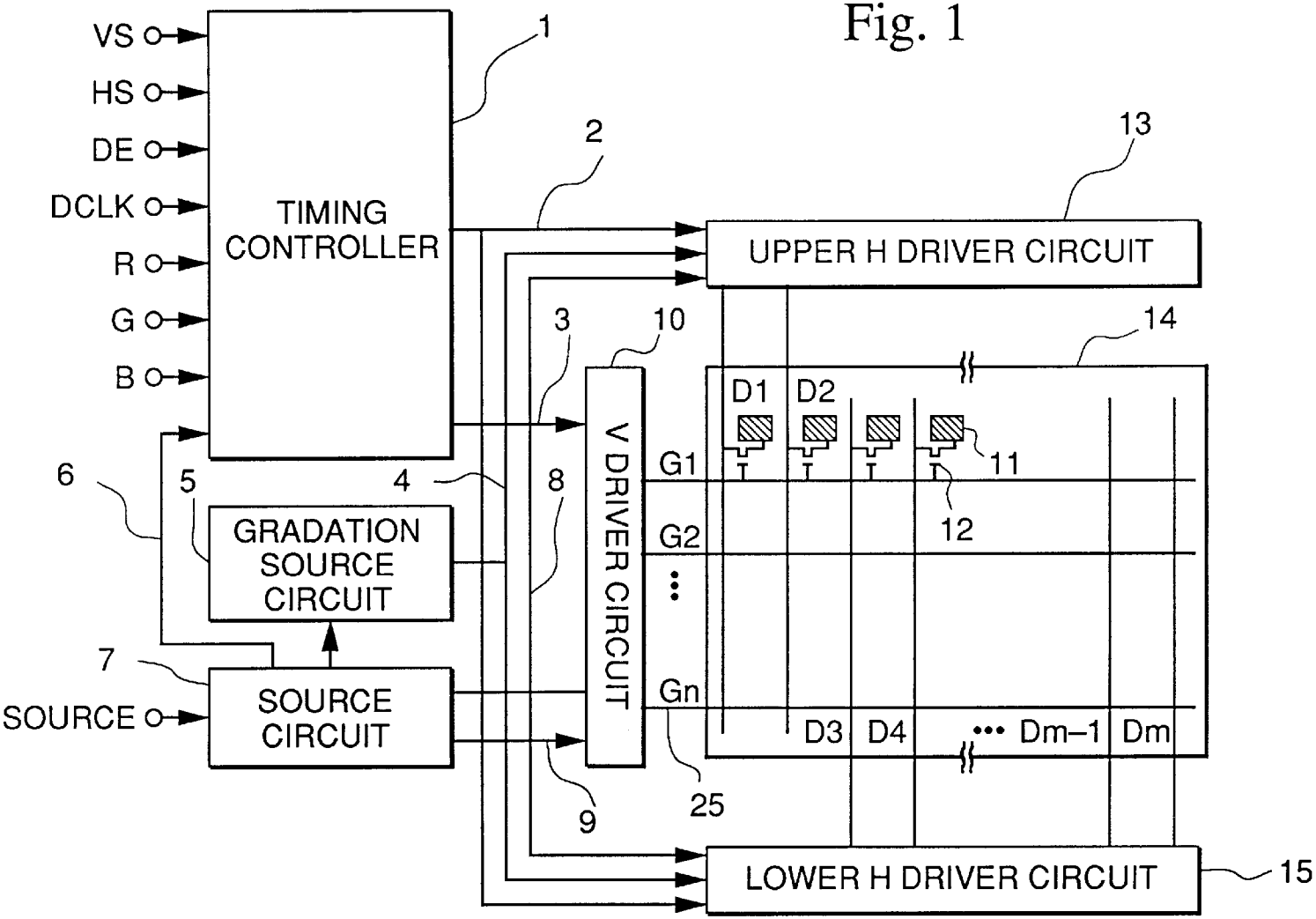
FIG. 1 is a diagram showing a structure of an embodiment of the present invention.

As shown in FIG. 1, data electrodes for every two data lines formed on a liquid crystal panel 14 are derived and connected to the first H driver circuit 13 and the second H driver circuit 15, respectively.

Any number of data lines to be derived and connected to each H driver can be adopted, if the number is n, which is an integer exponent of two.

These data line electrodes are connected to the existing H driver circuits and the first and second driver circuits 13 and 15 are controlled by a timing controller 1 such that the polarity of data is switched for each scanning line and each field.

Thereby, data with the opposite polarity is supplied to respective data electrodes D1, D3, D2x+1 (X=1, 2, 3, 4, . . . ) and data electrodes D2, D4, D2y (y=1, 2, 3, 4, . . . ). Consequently, the polarity inversion similar to the dot inversion driving is obtained.

Embodiments

In order to describe the present invention in more detail, preferred embodiments of the present invention will be described with reference to the attached drawings. FIG. 1 is a diagram showing a structure of an embodiment of the present invention. The illustrated liquid crystal display device is applied to notebook-type personal computers and displays data while driving each pixel (liquid crystal cell) of the liquid crystal panel by an active matrix driving method.

Referring to FIG. 1, the liquid crystal panel 14 is a color liquid crystal display panel, which is made by enclosing liquid crystal between a TFT (Thin Film Transistor) substrate and a counter substrate. On the counter substrate, a common electrode which is common to each pixel is provided. On the TFT substrate, n pieces of line-shaped scanning electrodes G1, G2, . . . Gn are formed extending in one direction of FIG. 1, m pieces of line-shaped data electrodes are formed in another direction perpendicular to the scanning electrodes, and those scanning electrodes and data electrodes divide the display panel into a latticed matrix. Each liquid crystal cell defined in rectangular regions of the latticed matrix corresponds to a liquid crystal cell, which is provided with a pixel electrode 11. The pixel electrode 11 is formed on the TFT substrate facing the common electrode formed on the counter substrate. Each liquid crystal cell is provided with a color filter having any one of colored layers of R (Red), G (Green), and B (Blue).

In the present embodiment, the data electrodes of every two lines are distributed to the upper and lower H drivers such that data electrodes D1, D2, . . . Dm−3, Dm−2 are distributed to the upper H driver 13, and data electrodes D3, D4, . . . , Dm−1, Dm are distributed to the lower H drivers.

The common electrode and the pixel electrodes are generally made of a transparent film, such as an ITO (Indium Tin Oxide) film. The scanning electrodes are made of metals with low resistivity such as tantalum (Ta), Molybdenum (Mo), Aluminum (Al), and Chromium (Cr), and the data electrodes are made of metals with low resistivity such as Aluminum (Al), Titanium (Ti), and Molybdenum (Mo).

In the vicinity of each of the crossover points between the scanning electrodes and the data electrodes on the TFT substrate, TFTs 12 as switching elements are formed, and each source electrode and drain electrode of said TFT are connected to data electrodes and pixel electrodes, respectively. An example of such a TFT is an amorphous silicon TFT.

Each gate electrode of the TFTs 12 of liquid crystal cells arranged in the direction of the scanning electrode are connected to a scanning electrode, and TFTs 12 become conductive only when high level scanning voltage is applied to the scanning electrodes. When the TFTs becomes conductive, the data voltage of the corresponding data electrode is also applied to the pixel electrode, the liquid crystal is driven by an electric field generated by the potential difference between the pixel electrode and the common electrode. The liquid crystal cell then displays a dot data for a pixel corresponding to the data voltage applied to the liquid cell.

The data voltage applied to the pixel electrode is supplied by the horizontal (H) driver circuits 13 and 15 which are connected to the data electrodes, and a vertical (V) driver circuit 10 is connected to the scanning electrode for supplying the scanning voltage.

The H driver circuits 13 and 15 is a existing H driver circuit comprising a high withstanding voltage 64 gradation LCD driver, which includes a D/A converter, weighed such that the γ-characteristic of the display coincides with the voltage to brightness characteristic of the liquid crystal panel for each bit of digital data composed of plural numbers of R, G, B bits, and the polarity of the output data at the time of driving by alternative currents becomes opposite to each other for the odd-numbered data and for the even-numbered data.

In order to generate a standard voltage for the D/A converter (not shown) in the H driver circuits 13 and 15, a gradation source circuit 5 is connected to the driver circuit. The gradation source circuit 5 supplies a fixed and stable reference voltage to the H drivers.

In order to display a uniform image data on the display screen, the H driver circuits 13 and 15 and V driver circuit 10 are controlled by the timing controller 1. The timing controller 1 is formed by an LSI containing gate arrays and cell base ICs. The timing controller generates a control signal for driving the liquid display panel 14 based on received inputs, such as the vertical synchronization signal (VS), the horizontal synchronization signal (HS), data enable signal (DE), dot clock (DCLK), and digital image signals (R, G, B), and the control signal is supplied to the V driver circuit 10 and the H driver circuits 13 and 15.

The source circuit 7 is a circuit block for supplying the power necessary for each circuit block from a single power source supplied to the liquid crystal display device, and usually a DC-DC converter is used as the source circuit.

Hereinafter, an operation at the time of dot inversion driving will be described in the active matrix-type liquid crystal display device according to the above embodiment of the present invention.

FIG. 2A is a diagram showing the polarity inversion in the dot inversion driving, and FIG. 2B is a diagram showing polarities of the screen after one field of FIG. 2A. As shown, the polarities are inversed for every scanning line and for every field.

Figure 3:
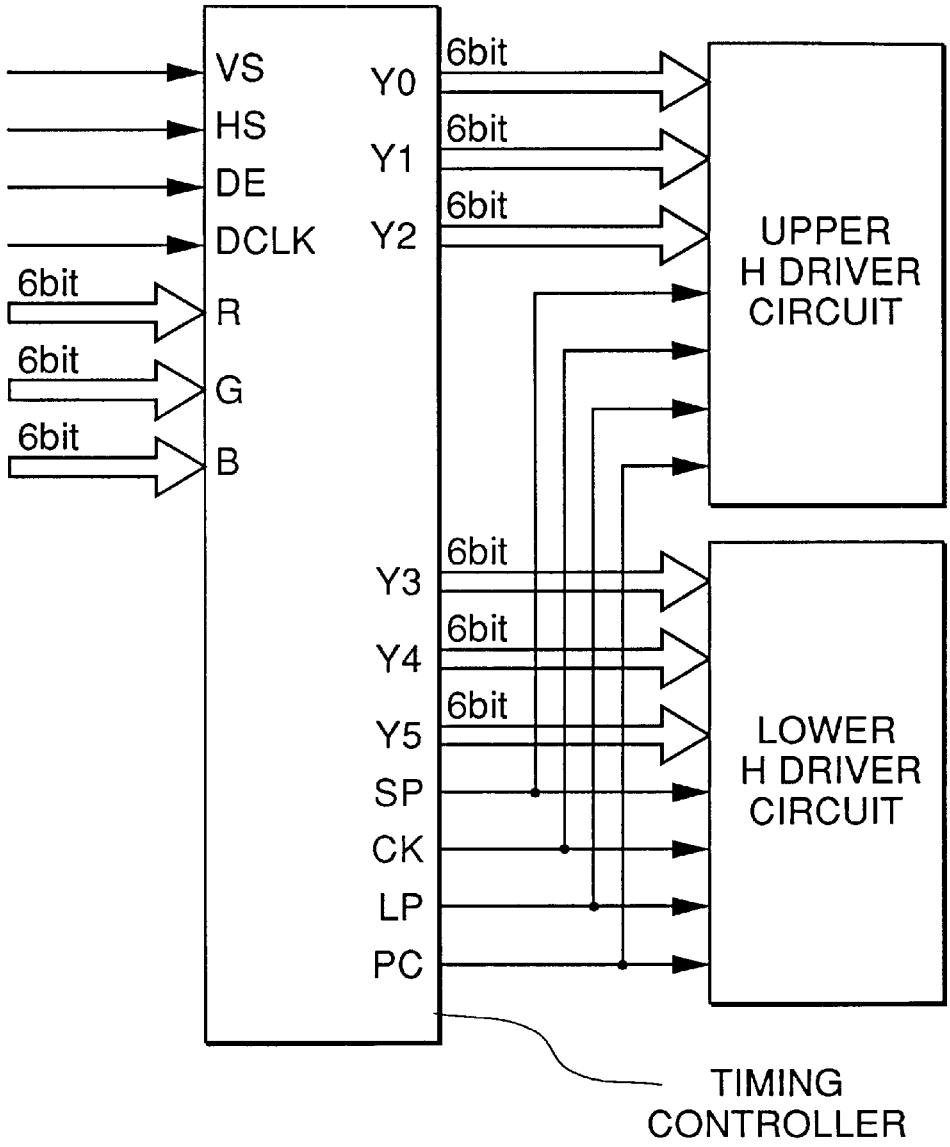
FIG. 3 is a diagram showing a connection between a timing controller and a H-driver circuit according to an embodiment of the present invention.

FIG. 3 shows a detailed connection between the timing controller 1 shown in FIG. 1, the upper driver circuit 13 and the lower driver circuit 15. Here, the upper and lower driver circuits 13 and 15 are digital-type drivers including a D/A converter, and these driver circuits are a existing H drivers which realize a 64 gradation display having digital data with a 6 bit bitwidth.

Figure 4:
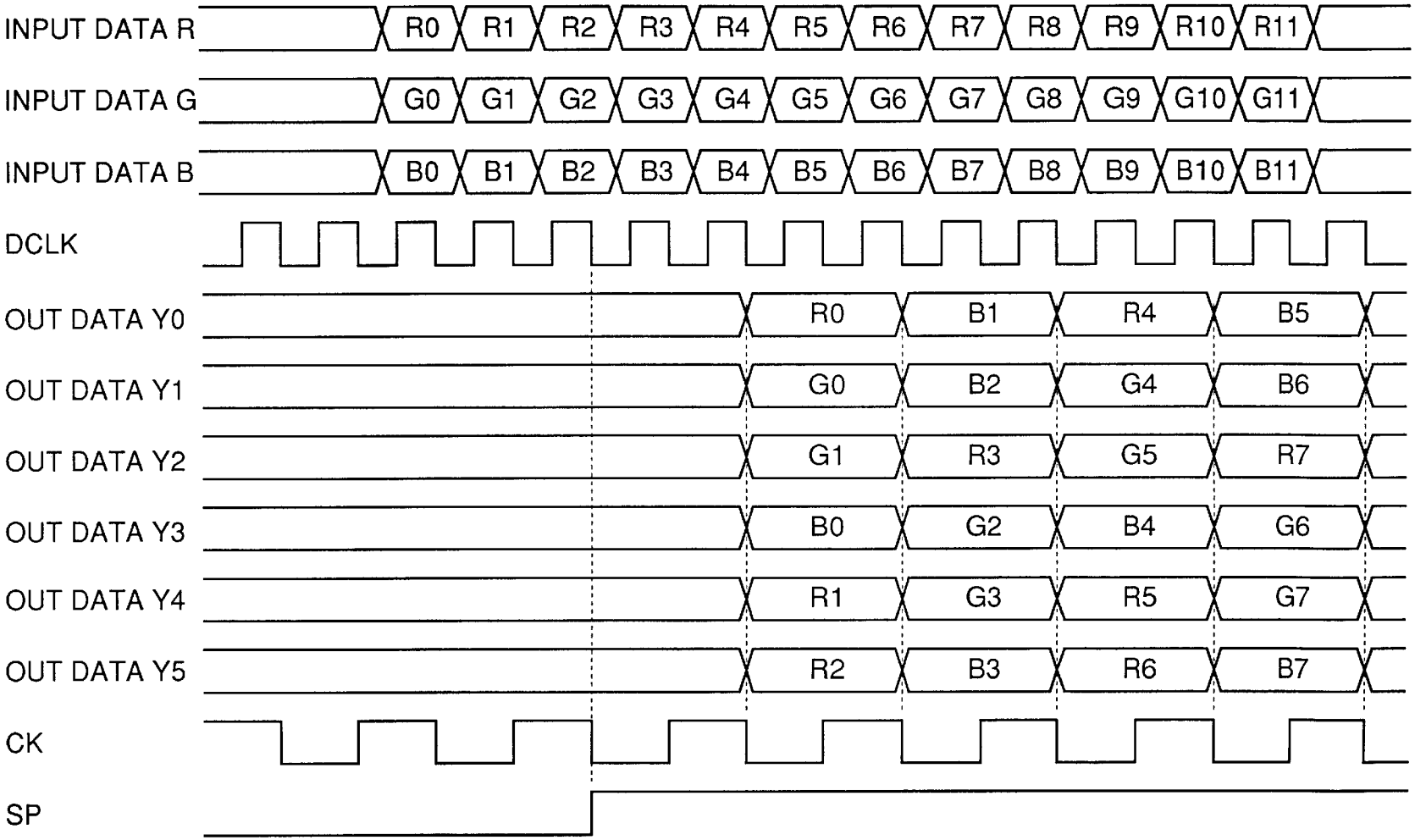
FIG. 4 is a timing chart showing operational timings of a control signal for controlling the H-driver circuit according to an embodiment of the present invention.

FIG. 4 shows a timing chart of control signals for the upper and lower H driver circuits 13 and 15 and the control signals are generated by the timing controller 1.

Referring to FIGS. 3 and 4, in order to distribute each 6 bits of R, G, and B image data synchronously input into the dot clock DCLK to the upper and lower drivers 13 and 15, the timing controller 1 rearranges the order of data synchronizing with the order of the arrangement of color filters formed for each liquid crystal cell and output at Y0, Y1, Y2, Y3, Y4 and Y5.

When Y0, Y1 and Y2 are connected to the upper H driver circuit 13, and when Y3, Y4 and Y5 are connected to the lower H driver circuit 15, the order of output data is arranged in a timing chart as shown in FIG. 4.

The data speed becomes a half of the original, since the number of data lines has doubled. That is, the speed (frequency) of the clock CK for driving the H drivers 13 and 15 is one-half that of the dot clock DCLK.

When considering a time margin in an alternative current driving of a logic circuit, it is general to output the output data (Y0, Y1, . . . , Y4, and Y5) from the timing controller 1 in synchronism at the falling edge of the clock (CK) signal, since the H driver circuits 13 and 15 take data at the leading edge of the clock (CK).

The signal SP shown in FIG. 3 is a pulse for indicating to the H driver circuits 13 and 15 to start sampling of image data.

Moreover, the signal LP is a control signal that instructs data obtained by sampling by the H drivers 13 and 15 to be output to the liquid crystal display panel 14 connected to these H drivers. When this signal LP becomes active, digital data obtained by the sampling are latched, and the latched digital data are converted by D/A conversion in order to be supplied to the liquid crystal display panel as analog signals.

The signal PC is a signal for controlling the polarity for AC driving of the liquid crystal, when the H driver circuits 13 and 15 output the analog data. In the conventional existing H drivers 3 and 15 used in this embodiment, when the signal is at a high level, the polarity of analog data at odd-numbers from the output terminal of the H driver is positive for the common potential of the liquid crystal panel, while the polarity of the analog data at the even numbered output is negative. In contrast, when the PC signal is at a low level, the polarity of an analog data output for the odd-numbers are negative for the common potential of the liquid crystal panel, and the analog data output for even numbers is positive.

Since the data electrodes on the liquid crystal panel 14 are drawn every two lines for the upper and lower drivers, when the polarity of the PC signal from the upper H driver circuit 13 is made the same as that of the PC signal from the lower H driver, the polarity of liquid cells adjacent to each other becomes opposite, in a horizontal view of liquid cells.

In the present embodiment, therefore, the dot inversion driving shown in FIG. 2 can be conducted when the PC signals from both upper and lower H drivers are output by the same polarities, and when the polarity for each horizontal synchronization signal and for each vertical synchronization signals is reversed.

Figures 5A, 5B:
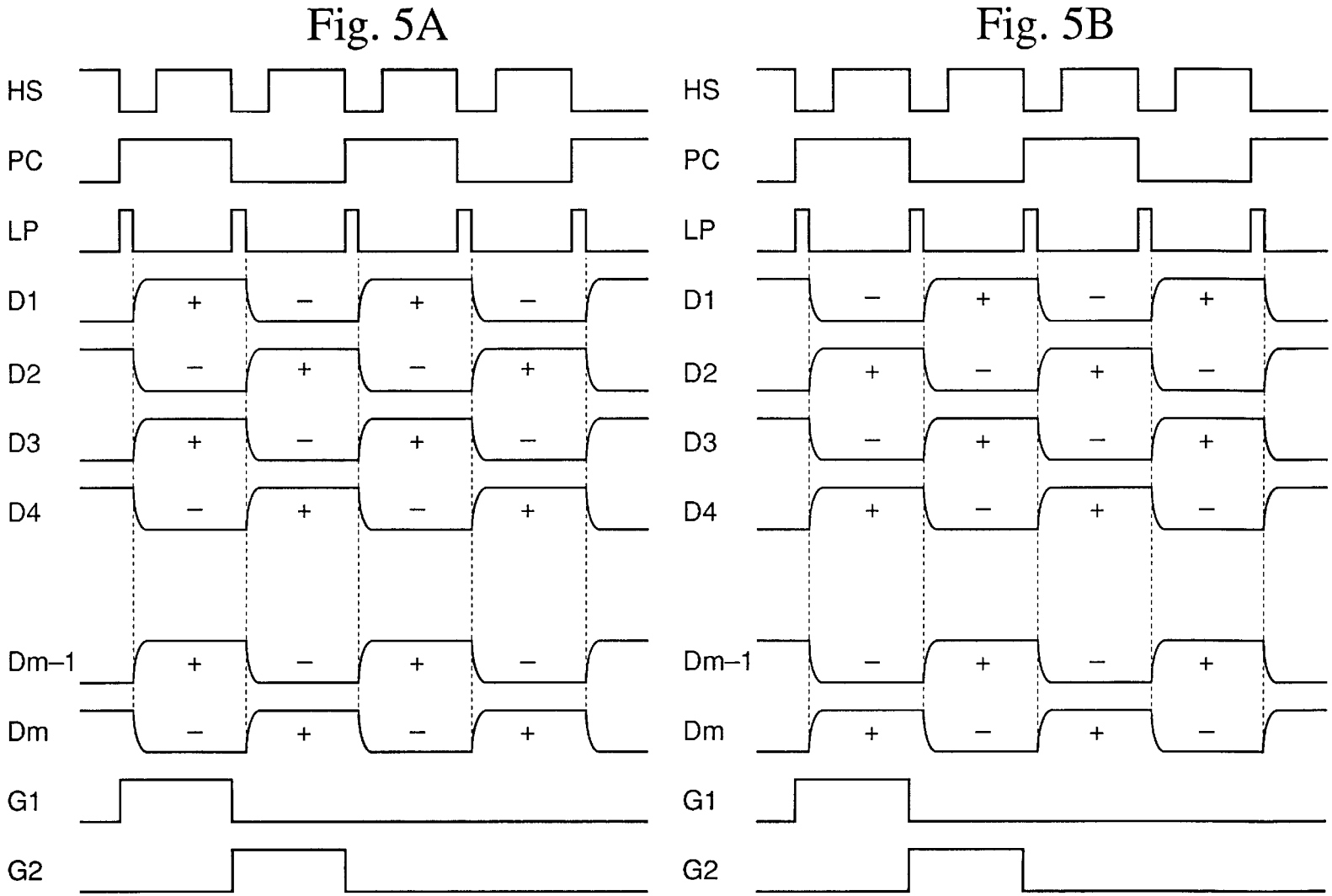
FIGS. 5A and 5B are timing charts showing operational timings of a dot inversion driving according to an embodiment of the present invention.

The driving waveforms obtained by such driving are shown in FIGS. 5A and 5B. The PC signals shown in FIGS., 5A and 5B are inversed into opposite polarities to each other. Thus, by switching the polarity at a frequency of the vertical synchronization frequency, the dot inversion driving is achieved.

Figure 6:
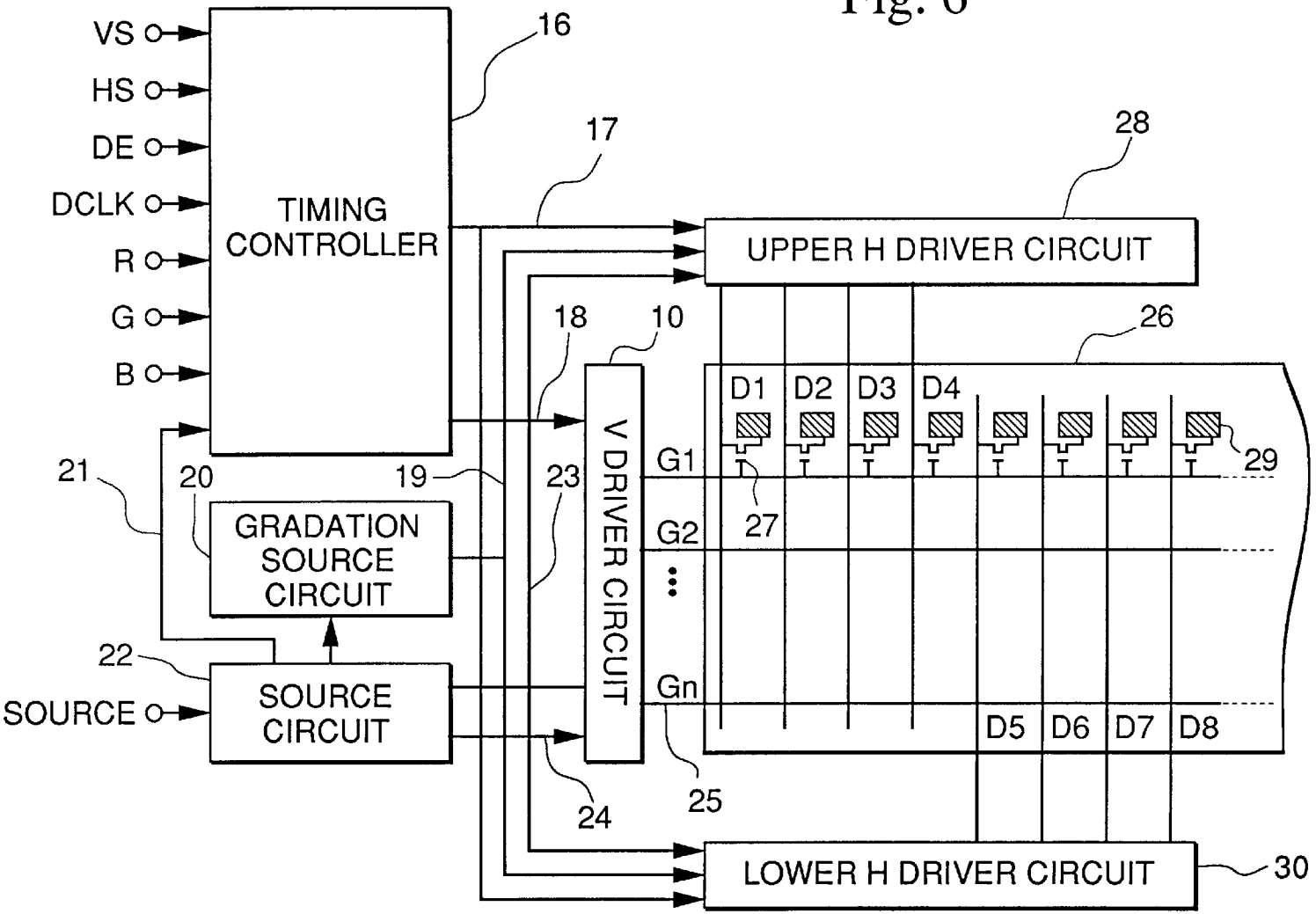
FIG. 6 is a diagram showing the structure of the second embodiment of the present invention.

The second embodiment of the present invention will be described. FIG. 6 is a diagram showing a structure of the second embodiment of the present invention. Referring to FIG. 6, in the second embodiment of the present invention, the data electrodes are derived to be connected to an H driver at an interval of four lines as an integer exponent of two. Since the other constitutions are the same as that of the above embodiment, the explanations of other constitutions are omitted.

Figure 7:
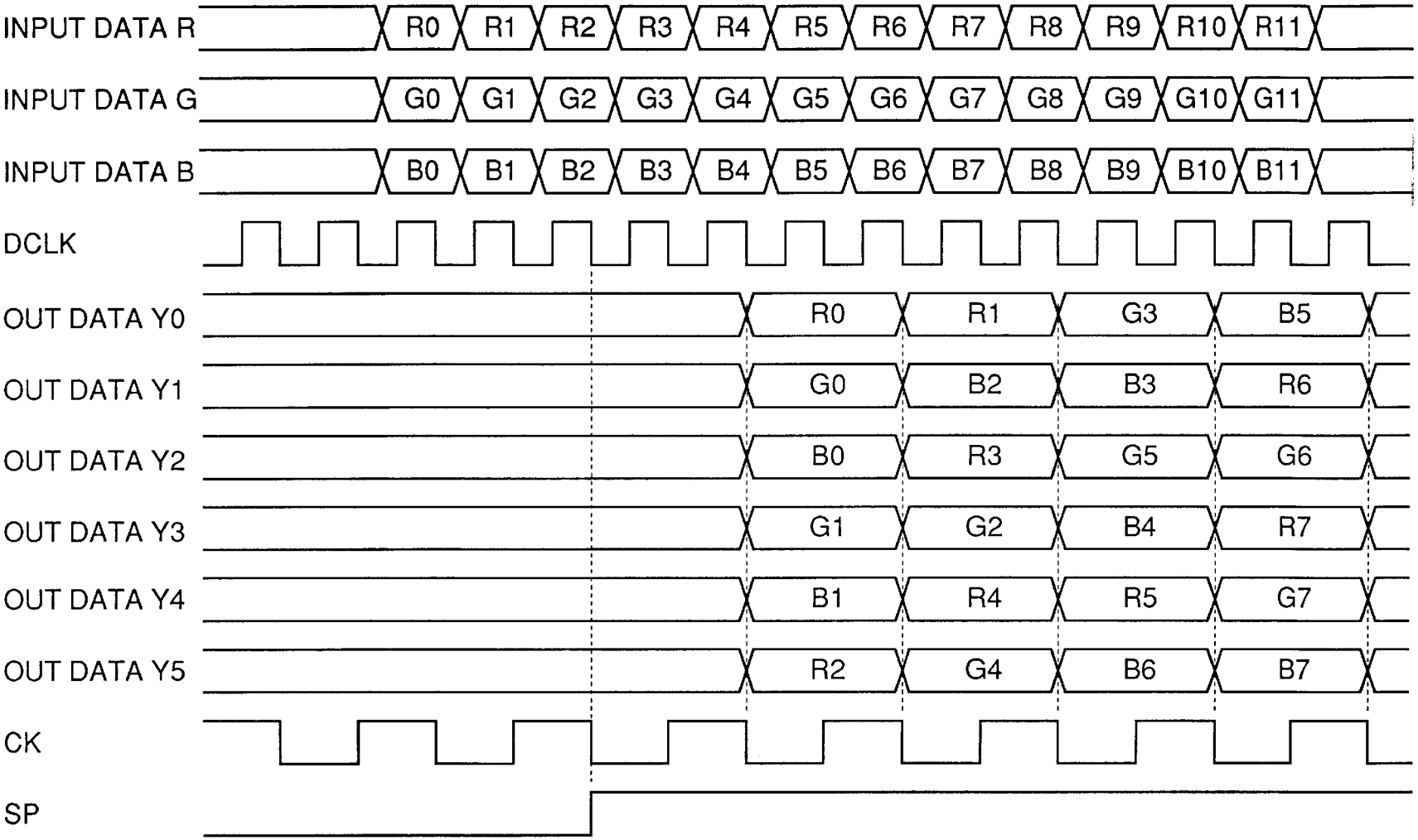
FIG. 7 is a timing chart showing operational timings of a control signal for controlling the H-driver circuit according to the second embodiment of the present invention.

In the second embodiments of the present invention, the relationship between the deriving positions of data electrodes and the dispositions of color filters differ from that of the previous embodiment, and the order of image data with R, G, and B colors output from output terminals from Y0 to Y5 of the timing controller 16. An example of the timing chart is shown in FIG. 7.

As hereinabove described, the present invention realizes a 6 inch active matrix-type liquid crystal display device of 6-inch type having a small screen size, the pixel pitch of which is 19 $\mu$m and the resolution of which is VGA, by adopting the dot inversion driving, known as a driving method of the active matrix-type liquid crystal display device in order to realize a high image quality eliminating an effect of cross-talk. The inversion driving is executed by disposing the conventional existing H-side driver circuits on both side of the liquid crystal panel and by connecting each two data electrodes to each H-side driver circuit such that it becomes possible to afford spaces for pressure welding the terminals for connecting the liquid crystal panel to the H side driver circuits.

According to the present invention, it is possible to use the conventional existing 64 gradation-type H driver, which outputs the odd numbered data and the even numbered data at opposite polarities to each other by deriving each two data electrodes for connecting alternately to the upper and lower H drivers. Therefore, since it is not necessary to develop new H drivers, the new liquid crystal display device will not require any additional development cost.

What is claimed is:

1. An active matrix-type liquid crystal panel comprising:

first and second horizontal driver circuits having data electrodes extending therefrom, which output odd output data and even output data at opposite polarities to each other;

wherein each of a first pair of immediately adjacent said data electrodes is connected to said first driver circuit and each of a second pair of immediately adjacent said data electrodes is connected to said second driver circuit, each of said driver circuits outputs odd output data and even output data at opposite polarities to immediately adjacent data electrodes extending from each driver circuit.

2. An active matrix-type liquid crystal panel comprising:

first and second horizontal driver circuits having data electrodes extending therefrom, which output odd output data and even output data at opposite polarities to each other;

wherein the data electrodes are divided into first and second groups of immediately adjacent said data electrodes, each said group consisting of an integer times two of said data electrodes, said first group being connected to said first driver circuit and said second group being connected to said second driver circuit, each of said driver circuits outputs odd output data and even output data at opposite polarities to immediately adjacent data electrodes extending from said driver circuit.

3. An active matrix-type liquid crystal panel comprising:

scanning electrodes and data electrodes arranged on a substrate;

a liquid crystal panel including active elements for transmitting electrode potentials activated by said scanning electrodes at cross over points of the scanning electrodes and the data electrodes, said scanning electrodes and said data electrodes forming a plurality of scanning electrode lines and a plurality of data electrode lines in a latticed matrix and cross at right angles;

first and second horizontal driving circuits disposed on both sides of the liquid crystal panel, said first and second driving circuits being driving circuits for driving said data electrodes and for outputting odd output data and even output data to a common electrode potential of the liquid crystal panel at opposite polarities to each other, each of a first pair of immediately adjacent said data electrodes is connected to said first driver circuit and each of a second pair of immediately adjacent said data electrodes is connected to said second driver circuit; and timing control circuits structured and arranged to control said first and second driving circuits so as to switch a polarity of data for every scanning electrode as well as every field.

4. An active matrix-type liquid crystal display device according to claim 3, wherein said first and second driving circuits comprise digital-analog conversion circuits and display at a predetermined degradation.

5. A liquid crystal display device according to claim 4, wherein said timing control circuits output data in a rearranged order conforming with an arrangement of color filters, said color filters being in every pixel cell for allocating image digital data to said first and second driver circuits.

6. An active matrix-type liquid crystal panel comprising:

first and second horizontal driver circuits having data electrodes extending therefrom, which output odd output data and even output data at opposite polarities to each other; and a vertical driver circuit having scanning electrodes extending therefrom, a plurality of switching elements and pixel electrodes, each of the plurality of switching elements and pixel electrodes being arranged at a crossover point between one of the scanning electrodes and one of the data electrodes;

wherein each of a first pair of immediately adjacent said data electrodes is connected through one of the switching elements to one of the pixel electrodes and is connected to said first driver circuit, and each of a second pair of immediately adjacent said data electrodes is connected through another one of the switching elements to another one of the pixel electrodes and is connected to said second driver circuit, and wherein each said scanning electrode is connected to a gate of a plurality of the switching elements.

* * * * *